US011617938B1

(12) United States Patent
Lorenzo et al.

(10) Patent No.: US 11,617,938 B1
(45) Date of Patent: Apr. 4, 2023

(54) IMPACT-REDUCING DASHER BOARD ASSEMBLY

(71) Applicants: Covestro LLC, Pittsburgh, PA (US); Athletica Sports Systems Inc., Waterloo (CA); Pittsburgh Penguins LP, Pittsburgh, PA (US)

(72) Inventors: Jim Lorenzo, Mars, PA (US); Jacob Moore, Waterloo (CA); Mark Bondi, Pittsburgh, PA (US); Bruce W. Irving, Walters Falls (CA); Brandon Radeke, Mars, PA (US)

(73) Assignees: Covestro LLC, Pittsburgh, PA (US); Athletica Sports Systems Inc., Waterloo (CA); Pittsburgh Penguins LP, Pittsburgh, PA (US)

( * ) Notice: Subject to any disclaimer, the term of this patent is extended or adjusted under 35 U.S.C. 154(b) by 2 days.

(21) Appl. No.: 17/488,227

(22) Filed: Sep. 28, 2021

(51) Int. Cl.
*A63C 19/08* (2006.01)
*A63C 19/10* (2006.01)

(52) U.S. Cl.
CPC ..... *A63C 19/08* (2013.01); *A63C 19/10* (2013.01); *A63C 2019/085* (2013.01)

(58) Field of Classification Search
CPC ..... A63C 19/06; A63C 19/08; A63C 19/10; A63C 19/12; A63B 71/08; E04C 2/22; E04C 2/46
USPC ..... 472/92–94
See application file for complete search history.

(56) References Cited

U.S. PATENT DOCUMENTS 3,727,888 A 4/1973 Nickolas
5,709,099 A * 1/1998 Blades ..... A63C 19/10 165/53
6,004,217 A 12/1999 Johnston et al.
10,569,156 B2 2/2020 Seguin
2009/0137329 A1 5/2009 Palumbo et al.
2013/0040746 A1* 2/2013 Kapsalis ..... A63C 19/10 472/94
2015/0151187 A1* 6/2015 Riley ..... A63C 19/08 472/94

FOREIGN PATENT DOCUMENTS

KR 20100113428 A 10/2010

OTHER PUBLICATIONS

International Search Report and Written Opinion—PCT/US22/23101, dated Jul. 13, 2022.

* cited by examiner

*Primary Examiner* — Kien T Nguyen
(74) *Attorney, Agent, or Firm* — Reed Smith LLP; Matthew P. Frederick; John M. Cogill

(57) ABSTRACT

Devices and methods for dasher board assemblies for sports such as hockey. The dasher board assemblies of various embodiments are configured to reduce impact forces when a user collides with the assembly by increasing the flexibility of the dasher board, which allows for a more gradual deceleration. In some embodiments, the dasher board assembly defines a gap behind the dasher board to allow space for deceleration. In certain embodiments, a foam material is placed between the dasher board and a frame of the assembly. In embodiments, a spline connects adjacent dasher boards without rigid connection to adjacent vertical frame elements. In embodiments, the assembly is configured to provide puck play characteristics that are comparable to conventional dasher board assemblies.

20 Claims, 4 Drawing Sheets

IMPACT-REDUCING DASHER BOARD ASSEMBLY

FIELD OF THE INVENTION

The present invention is directed to a dasher board assembly for an ice hockey rink.

BACKGROUND OF THE INVENTION

A dasher board assembly, for example bordering a hockey rink, can be a significant source of injuries, including head injuries, when a user impacts the assembly.

SUMMARY OF THE INVENTION

A feature and benefit of embodiments is an impact-reducing dasher board assembly, comprising an envelope height and an envelope depth; a pair of vertical end frames positioned at first and second lateral ends of the assembly; a top frame element extending between the pair of vertical end frame elements at a top end of the dasher board assembly; a bottom frame element extending between the pair of vertical end frame elements at a bottom end of the dasher board assembly; a vertical mid frame element positioned between the pair of vertical end frame elements, the vertical mid frame element extending from the top end to the bottom end of the dasher board assembly; a horizontal element intersecting the vertical mid frame element between the top end and the bottom end, the vertical mid frame element and the horizontal element together defining a depth that is less than a depth of the vertical end frame elements; a foam strip formed of high resilience polyurethane mounted in front of the horizontal element; a dasher board positioned in front of the foam strip, the dasher board formed of polycarbonate and defining a thickness of about ⅜ inch, the dasher board further comprising a dasher board front face; a spline extending laterally from the dasher board and configured to attach the dasher board to a dasher board of an adjacent dasher board assembly, wherein the dasher board is only rigidly connected to the top frame element and the bottom frame element and only connects to the spline in between the top and bottom ends of the dasher board assembly; a kickboard rigidly mounted to the bottom frame element; and a hinge assembly configured to mount the assembly to a ground surface and configured to permit pivoting of the dasher board assembly about a horizontal axis.

In embodiments, the foam strip in front of the horizontal element is the only foam material in the dasher board assembly.

In embodiments, the foam strip comprises a thickness of about 3-4 inches.

In embodiments, the foam strip is configured to dampen vibrations of the dasher board after an impact and increase duration of the impact.

In embodiments, the horizontal element being is mounted recessed within the vertical mid frame element providing a flush face at the intersection of the horizontal element and the vertical mid frame element.

In embodiments, the flush face is spaced from the dasher board to define a gap of about 2.5-3.5 inches, wherein the dasher board assembly is configured to permit flexure of the dasher board into the gap to reduce negative acceleration of impacts with the dasher board assembly.

In embodiments, the gap being defined in all areas of the dasher board except along the bottom frame element and the top frame element.

In embodiments, the horizontal element comprises a cross-section defining an open side oriented toward the dasher board, the open side configured to receive the foam strip.

In embodiments, the pair of vertical end frame elements define a depth of 5 inches.

In embodiments, the assembly defines the overall envelope dimensions in conformance with standard hockey boards.

In embodiments, the spline is positioned at the second lateral end of the dasher board assembly and comprises the same material as the dasher board.

In embodiments, the dasher board assembly further comprises a receiver at the first lateral end, the receiver configured to receive a spline from an adjacent dasher board to form a joint.

In embodiments, a bolt assembly is configured to rigidly attach each vertical end frame element to a vertical end frame element of an adjacent dasher board assembly.

In embodiments, the kickboard provides a front face flush with the dasher board.

In embodiments, the hinge assembly comprises a spring biasing the dasher board assembly toward an upright position.

In embodiments, the hinge assembly comprises a hinge mounted below the bottom frame element and located at the front of the dasher board assembly proximate the kickboard, the spring mounted about a bolt located at a rear of the dasher board assembly.

In embodiments, a transparent panel supported by a cap assembly is rigidly mounted to a top frame element, the cap assembly comprising ribs or channels to absorb impacts.

In embodiments, a transparent panel extends upward and a shield mounted at each lateral end of the transparent panel, the shield configured to provide a seamless assembly with adjacent transparent panels.

A feature and benefit of embodiments is an impact-reducing dasher board assembly defining an overall envelope height, width, and depth, the assembly comprising: a dasher board of a thickness less than ½ inch, the dasher board comprising polycarbonate; a pair of vertical end frame elements positioned at first and second lateral ends of the assembly, the pair of vertical end frame elements comprising a depth; a vertical mid frame element positioned between the pair of vertical end frame elements and extending along substantially the entire height of the dasher board assembly; a horizontal element intersecting the vertical mid frame element, the vertical mid frame element and the horizontal element together defining a combined depth that is less than a depth of the vertical end frame elements; and a spline configured to attach the dasher board to a dasher board of an adjacent dasher board assembly, the spline comprising polycarbonate, wherein the dasher boards are not directly connected to the pair of vertical end frame elements, wherein the horizontal element is mounted recessed within the vertical mid frame element providing a flush face at the intersection of the horizontal element and the vertical mid frame element, the flush face spaced from the dasher board to define a gap of about 2.5 inches to about 3.5 inches, and wherein the dasher board assembly is configured to permit flexure of the dasher board into the gap.

In embodiments, the dasher board assembly does not comprise a foam material mounted between the horizontal element and the dasher board.

In embodiments, a hinge assembly is configured to mount the assembly to a ground surface and configured to permit pivoting of the dasher board assembly about a horizontal axis.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
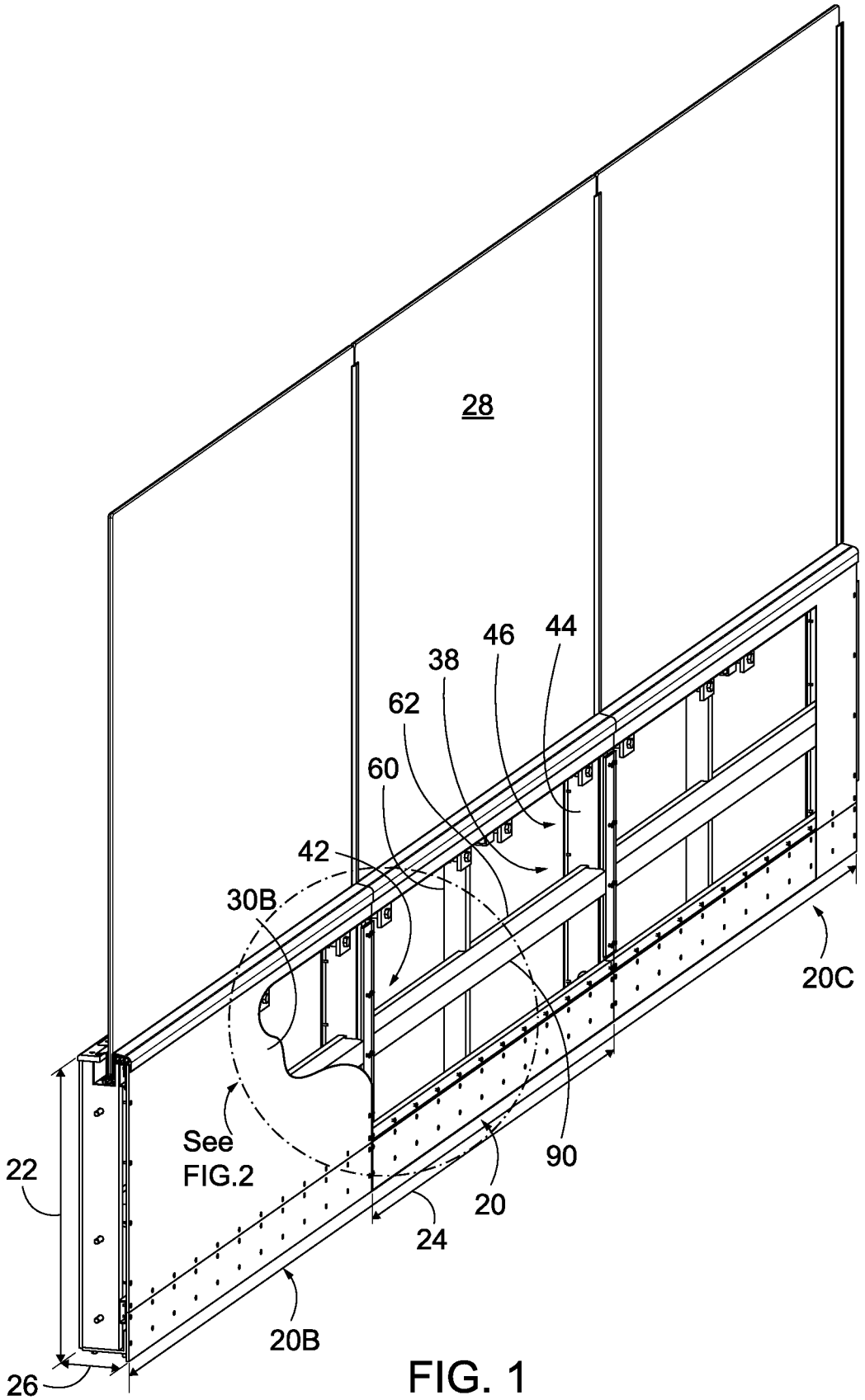
FIG. 1 is a front perspective view of an example dasher board assembly with a dasher board partially cut away in accord with embodiments of the present disclosure, and connected to additional dasher board assemblies.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIG. 1, an embodiment of dasher board assembly 20 is shown connected in series with additional dasher board assemblies 20B, 20C. In certain embodiments, the additional dasher board assemblies 20B, 20C are substantially the same as the dasher board assembly 20 with similar reference numerals used for similar parts, although embodiments including other applicable dasher board assemblies may be curved along the width while otherwise having a substantially similar construction and dimensions. In some embodiments, the dasher board assembly 20 comprises an overall envelope that is substantially equivalent to a standard dasher board with dimensions defined by, for example, a sport regulating body such as the National Hockey League (NHL) or the International Ice Hockey Federation (IIHF). In the illustrated embodiment, the dasher board assembly 20 defines an envelope height 22 of about 40 to 48 inches and in certain embodiments about 42 inches, envelope width 24 of about 6 to 12 feet, and an envelope depth 26 of about 6 inches. One or more of the envelope height 22, envelope width 24, and an envelope depth 26 may correspond to the size of a standard dasher board as defined by a sport regulating body. In embodiments, the dimensions comprise an envelope depth of about 6 inches or about 5 inches, and an envelope height of about 41 to 45 inches, and in certain embodiments about 44 inches. In some embodiments, a transparent panel 28 extends upward from the dasher board assembly 20. It will be appreciated that dasher board assemblies 20 may be implemented in various other settings for various sports or other activities, and as such the present disclosure is not limited to hockey boards.

In certain embodiments, the dasher board assembly 20 comprises a dasher board 30 that provides a planar front face of the dasher board assembly 20 for facing the rink or field of play. In the illustrated embodiment, the dasher board 30 defines a thickness 32 of about ⅜." In certain embodiments, the thickness 32 may be about ¾", about ⅝", about ½" about ¼", or any range between these values. For example, in some embodiments the thickness 32 may be from about ¼" to about ½." In other embodiments, thickness 32 may be less than ½." In still further embodiments, thickness 32 may be about ⅜" or less. In certain embodiments, dasher board 30 thickness 32 is relatively thinner than conventional boards, which are typically about ½" and made from high density polyethylene (HDPE).

In certain embodiments, dasher board 30 is formed from polycarbonate material. The relative reduced thickness of certain embodiments of dasher board 30 compared to conventional boards, and along with the polycarbonate material, provides greater elasticity, flexibility, and/or resilience compared to conventional board materials, resulting in more board flexure under a given impact load as compared to conventional boards.

Embodiments of polycarbonate material or thermoplastic compositions that partially comprise polycarbonate that are applicable to the present disclosure are discussed in World Intellectual Property Organization Application Publication No. WO2021/076561 and U.S. Patent Application Publication No. 2014/0356551, the entire disclosures of which are incorporated herein in their entirety and for all purposes. In embodiments, the polycarbonate comprises a high viscosity polycarbonate formed from an extrusion manufacturing process. In general, such polycarbonate material is more resilient, e.g., having a greater modulus of elasticity or elongation at break, as compared to conventional dasher board materials such as HDPE. Moreover, the properties of the polycarbonate material allow for a relatively thinner dasher board compared to standard thickness HDPE boards.

In certain embodiments, the polycarbonate formulation exhibits the following properties: a melt volume flow rate between 5 and 7 $cm^3$/10 mins. according to ISO 1133; a tensile modulus of between 2350-2450 MPa according to ISO 527-1,-2; a yield stress greater than or equal to 65 MPa according to ISO 527-1,-2; and a nominal strain at break of >50% according to ISO 527-1,-2. In an embodiment, the polycarbonate material or thermoplastic composition that partially comprises polycarbonate is a thermoplastic composition comprising (A) 30.0 to 100.0 parts by wt. of at least one aromatic polycarbonate, (B) 0.0 part by wt. to 50.0 parts by wt. of rubber-modified graft polymer and/or vinyl copolymer, (C) 0.00 to 50.00 part by wt. of polyester, (D) 5.0 to 50.0 parts by wt. of at least one inorganic filler having a grain shape selected from the group consisting of spherical, cubic, tabular, discus-shaped and lamellar geometries, and (E) 0.00 to 5.00 parts by wt. of further additives, wherein the sum of the parts by weight of components A) to E) adds up to 100 parts by weight.

As further embodiments, polycarbonates in embodiments of the present invention are both homopolycarbonates and copolycarbonates; the polycarbonates can be linear or branched in a known manner.

Aromatic polycarbonates and/or aromatic polyester carbonates according to component A which are suitable according to the invention are known from the literature or can be prepared by processes known from the literature (for the preparation of aromatic polycarbonates see, for example, Schnell, "Chemistry and Physics of Polycarbonates", Interscience Publishers, 1964 and DE-AS 1 495 626, DE-A 2 232 877, DE-A 2 703 376, DE-A 2 714 544, DE-A 3 000 610, DE-A 3 832 396; for the preparation of aromatic polyester carbonates e.g. DE-A 3 007 934).

Aromatic polycarbonates are prepared e.g. by reaction of diphenols with carbonic acid halides, preferably phosgene, and/or with aromatic dicarboxylic acid dihalides, preferably benzenedicarboxylic acid dihalides, by the interfacial process, optionally using chain terminators, for example monophenols, and optionally using branching agents which are trifunctional or more than trifunctional, for example triphenols or tetraphenols. A preparation via a melt polymerization process by reaction of diphenols with, for example, diphenyl carbonate is likewise possible. Diphenols for the preparation of the aromatic polycarbonates and/or aromatic polyester carbonates are preferably those of the formula (I)

(I)

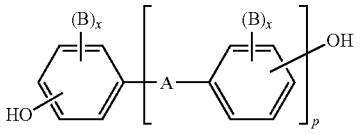

wherein

A is a single bond, C1 to C5-alkylene, C2 to C5-alkylidene, C5 to C6-cycloalkylidene, —O—, —SO—, —CO—, —S—, —SO2-, C6 to C12-arylene, on to which further aromatic rings optionally comprising hetero atoms can be fused, or a radical of the formula (II) or (III)

(II)

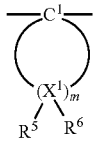

(III)

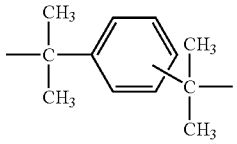

B is in each case C1 to C12-alkyl, preferably methyl, halogen, preferably chlorine and/or bromine, x is in each case independently of each other 0, 1 or 2, P is 1 or 0, and R5 and R6 can be chosen individually for each X1 and independently of each other denote hydrogen or C1 to C6-alkyl, preferably hydrogen, methyl or ethyl, X1 denotes carbon and m denotes an integer from 4 to 7, preferably 4 or 5, with the proviso that on at least one atom X1 R5 and R6 are simultaneously alkyl.

Preferred diphenols are hydroquinone, resorcinol, dihydroxydiphenols, bis-(hydroxyphenyl)-C1-C5-alkanes, bis-(hydroxyphenyl)-C5-C6-cycloalkanes, bis-(hydroxyphenyl) ethers, bis-(hydroxyphenyl) sulfoxides, bis-(hydroxyphenyl) ketones, bis-(hydroxyphenyl) sulfones and α,α-bis-(hydroxyphenyl)-diisopropylbenzenes and derivatives thereof brominated on the nucleus and/or chlorinated on the nucleus.

Particularly preferred diphenols are 4,4'-dihydroxydiphenyl, bisphenol A, 2,4-bis-(4-hydroxyphenyl)-2-methylbutane, 1,1-bis-(4-hydroxyphenyl)-cyclohexane, 1,1-bis-(4-hydroxyphenyl)-3,3,5-trimethylcyclohexane, 4,4'-dihydroxydiphenyl sulfide, 4,4'-dihydroxydiphenyl sulfone and di- and tetrabrominated or chlorinated derivatives thereof, such as, for example, 2,2-bis-(3-chloro-4-hydroxyphenyl)-propane, 2,2-bis-(3,5-dichloro-4-hydroxyphenyl)-propane or 2,2-bis-(3,5-dibromo-4-hydroxyphenyl)-propane. 2,2-Bis-(4-hydroxyphenyl)-propane (bisphenol A) is particularly preferred.

The diphenols can be employed individually or as any desired mixtures. The diphenols are known from the literature or obtainable by processes known from the literature.

Chain terminators which are suitable for the preparation of the thermoplastic, aromatic polycarbonates are, for example, phenol, p-chlorophenol, p-tert-butylphenol or 2,4,6-tribromophenol, but also long-chain alkylphenols, such as 4-[2-(2,4,4-trimethylpentyl)]-phenol, 4-(1,3-tetramethylbutyl)-phenol according to DE-A 2 842 005 or monoalkylphenols or dialkylphenols having a total of 8 to 20 carbon atoms in the alkyl substituents, such as 3,5-di-tert-butylphenol, p-iso-octylphenol, p-tert-octylphenol, p-dodecylphenol and 2-(3,5-dimethylheptyl)-phenol and 4-(3,5-dimethylheptyl)-phenol. The amount of chain terminators to be employed is in general between 0.5 mol % and 10 mol %, based on the sum of the moles of the particular diphenols employed.

The thermoplastic aromatic polycarbonates have average molecular weights (weight-average Mw, measured by GPC (gel permeation chromatography) with a polycarbonate standard) of from 10,000 to 200,000 g/mol, preferably 15,000 to 80,000 g/mol, particularly preferably 24,000 to 32,000 g/mol.

The thermoplastic, aromatic polycarbonates can be branched in a known manner, and in particular preferably by incorporation of from 0.05 to 2.0 mol %, based on the sum of the diphenols employed, of compounds which are trifunctional or more than trifunctional, for example those having three and more phenolic groups. Preferably, linear polycarbonates, further preferably based on bisphenol A, are employed.

Both homopolycarbonates and copolycarbonates are suitable. 1 to 25 wt. %, preferably 2.5 to 25 wt. %, based on the total amount of diphenols to be employed, of polydiorganosiloxanes having hydroxyaryloxy end groups can also be employed for the preparation of the copolycarbonates according to the invention according to component A. These are known (U.S. Pat. No. 3,419,634) and can be prepared by processes known from the literature. Copolycarbonates containing polydiorganosiloxane are likewise suitable; the preparation of copolycarbonates containing polydiorganosiloxane is described, for example, in DE-A 3 334 782.

Preferred polycarbonates are, in addition to the bisphenol A homopolycarbonates, the copolycarbonates of bisphenol A with up to 15 mol %, based on the sum of the moles of diphenols, of other diphenols mentioned as preferred or particularly preferred, in particular 2,2-bis-(3,5-dibromo-4-hydroxyphenyl)-propane.

Aromatic dicarboxylic acid dihalides for the preparation of aromatic polyester carbonates are preferably the diacid dichlorides of isophthalic acid, terephthalic acid, diphenyl ether 4,4'-dicarboxylic acid and of naphthalene-2,6-dicarboxylic acid.

Mixtures of the diacid dichlorides of isophthalic acid and of terephthalic acid in a ratio of between 1:20 and 20:1 are particularly preferred.

A carbonic acid halide, preferably phosgene, is additionally co-used as a bifunctional acid derivative in the preparation of polyester carbonates.

Possible chain terminators for the preparation of the aromatic polyester carbonates are, in addition to the monophenols already mentioned, also chlorocarbonic acid esters thereof and the acid chlorides of aromatic monocarboxylic acids, which can optionally be substituted by C1 to C22-alkyl groups or by halogen atoms, and aliphatic C2 to C22-monocarboxylic acid chlorides.

The amount of chain terminators is in each case 0.1 to 10 mol %, based on the moles of diphenol in the case of the phenolic chain terminators and on the moles of dicarboxylic acid dichloride in the case of monocarboxylic acid chloride chain terminators.

One or more aromatic hydroxycarboxylic acids can additionally be employed in the preparation of aromatic polyester carbonates.

The aromatic polyester carbonates can be either linear or branched in a known manner (in this context see DE-A 2 940 024 and DE-A 3 007 934), linear polyester carbonates being preferred.

Branching agents which can be used are, for example, carboxylic acid chlorides which are trifunctional or more than trifunctional, such as trimesic acid trichloride, cyanuric acid trichloride, 3,3',4,4'-benzophenonetetracarboxylic acid tetrachloride, 1,4,5,8-naphthalenetetracarboxylic acid tetrachloride or pyromellitic acid tetrachloride, in amounts of from 0.01 to 1.0 mol-% (based on the dicarboxylic acid dichlorides employed), or phenols which are trifunctional or more than trifunctional, such as phloroglucinol, 4,6-dimethyl-2,4,6-tri-(4-hydroxyphenyl)-hept-2-ene, 4,6-dimethyl-2,4,6-tri-(4-hydroxyphenyl)-heptane, 1,3,5-tri-(4-hydroxyphenyl)-benzene, 1,1,1-tri-(4-hydroxyphenyl)-ethane, tri-(4-hydroxyphenyl)-phenylmethane, 2,2-bis[4,4-bis(4-hydroxyphenyl)-cyclohexyl]-propane, 2,4-bis(4-hydroxyphenylisopropyl)-phenol, tetra-(4-hydroxyphenyl)-methane, 2,6-bis(2-hydroxy-5-methylbenzyl)-4-methylphenol, 2-(4-hydroxyphenyl)-2-(2,4-dihydroxyphenyl)-propane, tetra-(4-[4-hydroxyphenylisopropyl]-phenoxy)-methane, 1,4-bis[4,4'-dihydroxytriphenyl)-methyl]-benzene, in amounts of from 0.01 to 1.0 mol %, based on the diphenols employed. Phenolic branching agents can be initially introduced with the diphenols; acid chloride branching agents can be introduced together with the acid dichlorides.

The content of carbonate structural units in the thermoplastic, aromatic polyester carbonates can vary as desired. Preferably, the content of carbonate groups is up to 100 mol %, in particular up to 80 mol %, particularly preferably up to 50 mol %, based on the sum of ester groups and carbonate groups. Both the ester and the carbonate content of the aromatic polyester carbonates can be present in the polycondensate in the form of blocks or in random distribution.

The thermoplastic, aromatic polycarbonates and polyester carbonates can be employed by themselves or in any desired mixture.

Figure 2:
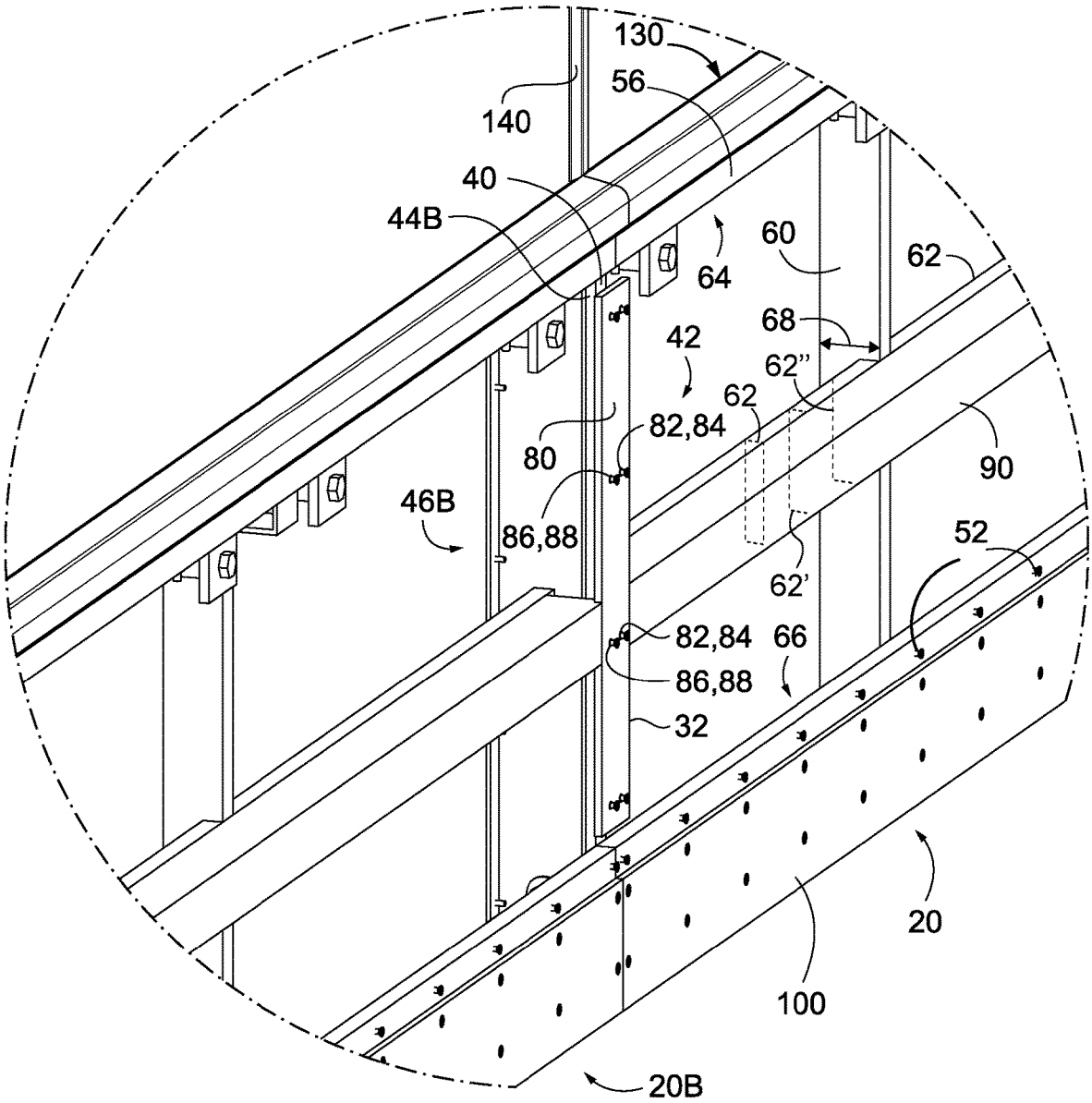
FIG. 2 is a zoomed partial perspective view of the example dasher board assembly of FIG. 1.

As shown in FIGS. 1 and 2, the dasher board assembly 20 in some embodiments has an internal frame assembly 38 including a first vertical end frame element 40 at a first lateral end 42 of the dasher board assembly and a second vertical end frame element 44 at a second lateral end 46 of the dasher board assembly. Each of the first and second vertical end frame elements 40, 44 defines a depth 48 that may be less than the envelope depth 26 of the dasher board assembly 20. In certain embodiments, the depth 48 of each of the pair of vertical end frame elements 40, 44 is 5" while the envelope depth 26 is 6", leaving a slot 50 that is about ⅝" deep behind the ⅜" dasher board 30.

Figure 3:
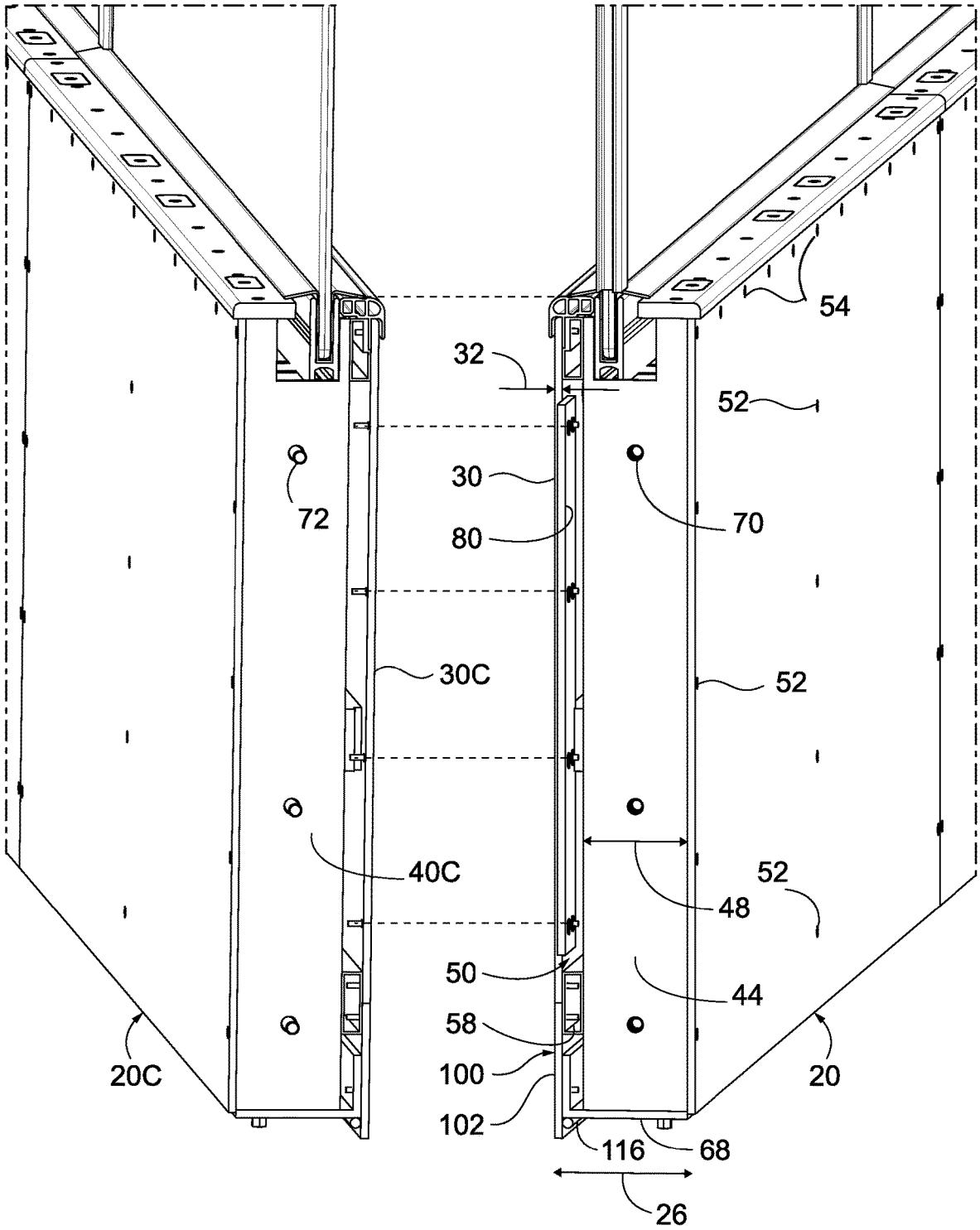
FIG. 3 is a partial rear perspective view of the example dasher board assembly of FIG. 1 disassembled from an adjacent additional dasher board assembly.

The internal frame assembly 38 rigidly supports the dasher board 30 by bolts 52, 54. As shown in FIG. 3, a plurality of bolts 52 are spaced about the dasher board. A plurality of upper bolts 54 mount the dasher board 30 to a top frame element 56. The top frame element 56 extends between the pair of vertical end frame elements 40, 44 and also supports mounting structure for the transparent panel 28. In certain embodiments, the bolts 52, 54 may have supplemental structures to impart flexibility and resiliency to the dasher board assembly 20. Nuts or washers (not shown) that are resilient (e.g., formed of rubber or the like) may be mounted on the bolts 52, 54 between the dasher board 20 and the corresponding member of the internal frame assembly 38. In other embodiments, a resilient nut may be provided only on the plurality of bolts 52 but not the plurality of upper bolts 54. The resilient nut may have a depth of about ⅛ inch-1 inch, about ¼-¾ inch, or about ½ inch. Such resilient nuts provide additional cushioning to the dasher board assembly 20, accommodate flexure of the dasher board 30, and reduce stresses on the bolt locations.

The internal frame assembly 38 of the illustrated embodiment further includes a bottom frame element 58, a vertical mid frame element 60, and a horizontal element 62. The bottom frame element 58 extends between the pair of vertical end frame elements 40, 44 and in some embodiments may be rigidly affixed to both the dasher board 30 and a kickboard 100. The vertical mid frame element 60 is positioned between the pair of vertical end frame elements 40, 44 and extends from a top end 64 to a bottom end 66 of the dasher board assembly 20. In embodiments, the internal frame assembly 38 further includes a base member 68 for anchoring with the ground. In embodiments, intersecting elements of the frame assembly 38 are rigidly connected together (e.g., bolted) or pivotally attached to each other, including the top frame element 56 with each of the vertical end frame elements 40, 44 and the vertical mid frame element 60, the bottom frame element 58 with each of the vertical end frame elements 40, 44 and the vertical mid frame element 60, and the horizontal element 62 with each of the vertical end frame elements 40, 44 and the vertical mid frame element 60. In some embodiments, the horizontal element 62 crosses the vertical mid frame element 60 without any positive connection thereto.

In certain embodiments, the horizontal element 62 is mounted recessed within the vertical mid frame element 60 as shown in FIG. 2, providing a flush face at the intersection of the horizontal element and the vertical mid frame element. The horizontal element 62 intersects the vertical mid frame element 60 between top bottom ends of the vertical end frame element, and the horizontal element has a depth, whereby the vertical mid frame element and the horizontal element define a combined depth that is less than the depth of the pair of vertical end frame elements 40, 44. In certain embodiments, the vertical end frame elements 40, 44 have a depth of 5 inches while the combined depth of the horizontal element 62 and the vertical mid frame element 60 is about 2 to 4 inches. In embodiments, each of the vertical mid frame element 60, the horizontal element 62, and the vertical end frame elements 40, 44 is recessed from the dasher board 30 and do not span the entire depth between the dasher board 30 and a rear board.

Figure 4:
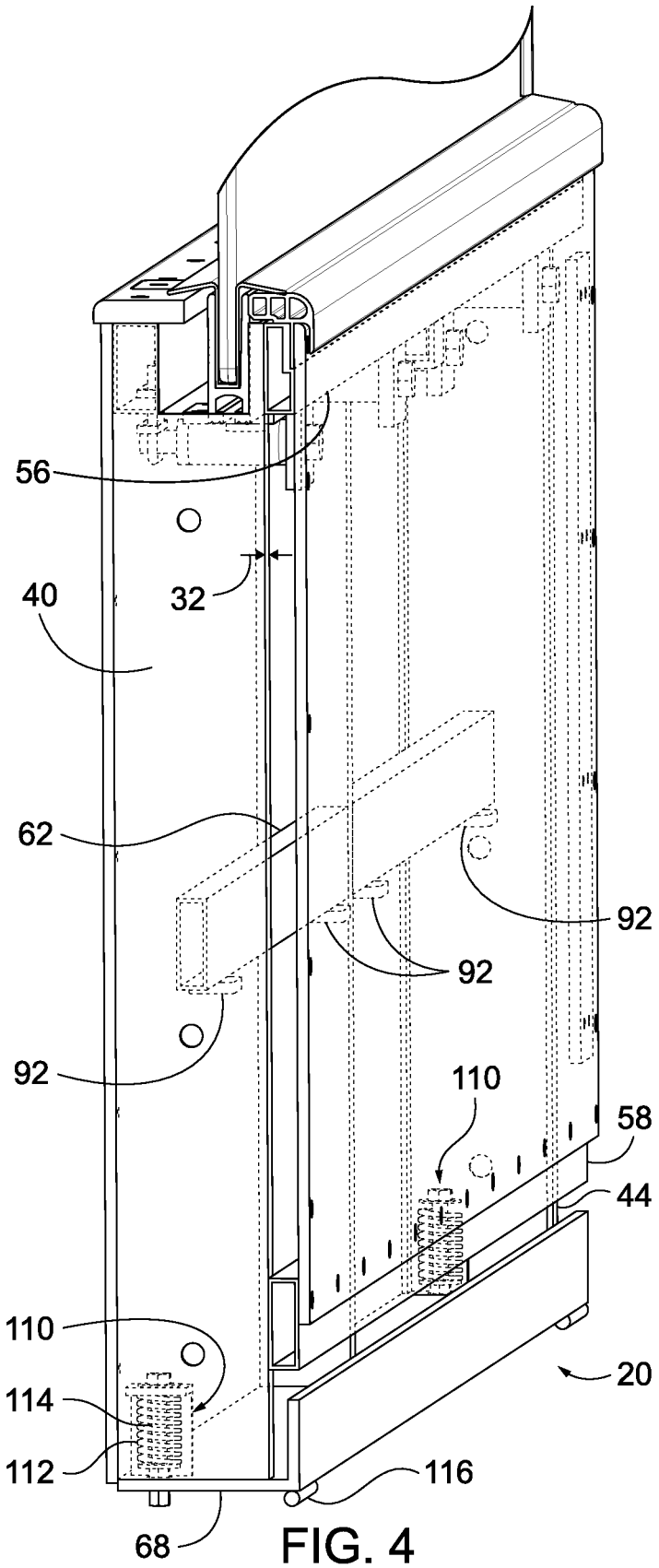
FIG. 4 is a side perspective view of the example dasher board assembly of FIG. 1 with certain parts removed.

In some embodiments, the flush face of the horizontal element 62 and the vertical mid frame element 60 is spaced from the dasher board 30 to define a gap of from about 0.5 inches to about 2 inches, and in embodiments about 0.75-1.25 inches, and in certain embodiments about 1 inch. This gap is measured without any foam installed (e.g., foam strip 90 discussed further below). This gap permits flexure of the dasher board 30 into the gap to reduce negative acceleration of impacts with the dasher board assembly. In certain embodiments, in areas where the dasher board 30 does not overlap with any portion of the frame assembly 38, the gap behind the dasher board is about 2-4 inches, and in some embodiments about 2.5-3.5 inches, and in certain embodiments about 3 inches. As shown in FIG. 4 and in relief in FIG. 2, the horizontal element 62 has a rectangular or box-shaped cross-section. In still further embodiments, the horizontal element 62 includes a cross-section defining an open side oriented toward the dasher board, for example in a "C" shape as shown at 62' or an "L" shape as shown at 62" in FIG. 2. In such embodiments, the open side of the "C" or "L" may be configured to receive the foam strip as described further herein.

As shown in FIG. 3, in certain embodiments the vertical end frame elements 40, 44 (e.g., 40C and 44 in FIG. 3) include bolt holes 70 for receiving bolts 72 to rigidly connect adjacent dasher board assemblies. The series of bolt holes 70 and bolts 72 may collectively be considered a bolt assembly connecting vertical frame elements of adjacent dasher board assemblies.

In embodiments, the internal frame assembly 38 may be formed of a rigid material; in certain embodiments the internal frame assembly is formed of metal such as steel, aluminum, and/or alloys thereof. One or more individual components of the internal frame assembly 38 may be formed of different materials. As discussed above, in embodiments the intersecting components of the internal frame assembly 38 are rigidly or pivotally affixed to each other, and in certain embodiments the bottom frame element 58 is rigidly affixed to each of the first and second vertical end frame elements 40, 44. Rigidly affixing components may include bolts, clamps, welding, or the like.

With reference to FIGS. 1-3, in embodiments the dasher board assembly 20 includes a spline 80 for supplemental connection of adjacent dasher board assemblies (for example, dasher board assembly 20 with dasher board assembly 20B or dasher board assembly 20 with dasher board assembly 20C). The spline 80 is affixed to the dasher board 30 of the dasher board assembly 20 and is also affixed to a corresponding adjacent dasher board 30B or 30C. The spline 80 is positioned on a rear side (i.e., toward the internal frame assembly 38 and away from the rink side when installed) of both the dasher board 30 and the dasher board 30B or 30C. In certain embodiments and as shown in FIG. 2, the spline 80 has holes 82 for bolts 84 mounting to the dasher board 30 and holes 86 for bolts 88 mounting to the adjacent dasher board 30B. When assembled between adjacent dasher boards, the spline 80 provides physical continuity between the dasher boards even when one or both of the dasher boards has temporarily moved, for example when flexing during impact. This physical continuity of plastic board material (for example, polycarbonate) provided across adjacent dasher board assemblies 20, 20B, 20C by the spline 80 prevents gaps from forming between adjacent dasher boards when one dasher board 30 moves relative to another and, as such, mitigates a possible pinch point caused by movement of the lateral edges of adjacent dasher boards 30. In certain embodiments, the dasher board assembly 20 of the present disclosure may otherwise be more susceptible to such pinch points during use due to the increased overall flexibility of the assembly. The spline 80 may also transfer loads between adjacent dasher boards, thus reducing impact by distributing the forces beyond a single dasher board assembly 20 to an adjacent dasher board assembly 20 and/or dasher board 30.

In certain embodiments, there are no connections between dasher board 30 and the internal frame assembly 38 at the joint between adjacent dasher boards, dasher board assemblies, and at or adjacent to the spline 80. In particular, the dasher board 30 of such embodiments is not directly or rigidly connected to the vertical end frame elements 40, 44, which is in contrast to conventional dasher board assemblies. Therefore, the dasher boards 30, 30B, 30C float over the vertical end frame elements 40, 44. The dasher board 30 is still rigidly connected to the top frame element 56 (via bolts 54) and the bottom frame element 58. The spline 80 of the illustrated embodiment is not fastened to the internal frame assembly 38 and is only attached to the dasher board 30.

In further reference to FIGS. 1 and 2, embodiments of the dasher board assembly 20 include a foam strip 90 positioned between the dasher board 30 and the internal frame assembly 38. In the illustrated embodiment, the foam strip 90 is mounted to the horizontal element 62 and extends across the entire width between the first and second vertical end frame elements 40, 44. The foam strip 90 has a cross-sectional shape that may be square, rectangular, or any other known shape. In certain embodiments, the foam strip 90 has a square cross section of about 3 inches high and 3 inches deep or 2 inches high and 2 inches deep. In embodiments, the foam strip 90 may have a depth of about 1-4 inches, or about 1.5-3.5 inches, or about 2-3 inches. In embodiments, the foam strip 90 does not occupy the entire gap between the dasher board 30 and the flush face of the horizontal element 62 overlapping with the vertical mid frame element 60, in some embodiments, the foam strip 90 does not occupy the entire gap behind the dasher board 30 at any point along the width of the dasher board. Accordingly, in such embodiments, space remains between the dasher board 30 and the foam strip 90. In other embodiments, the foam strip 90 occupies substantially the entire depth of the gap behind the dasher board 30.

As shown in the illustrated embodiment of FIG. 4, a series of brackets 92 support the foam strip 90 in position. The foam strip 90 in other embodiments may be mounted to horizontal element 62 by an adhesive in lieu of or in addition to the brackets 92. In certain embodiments, the horizontal element has a "C" shaped or "L" shaped cross-section 62' or 62", respectively, as shown in relief in FIG. 2, such shape providing a support ledge for the foam strip 90 without the use of the brackets 92. In some embodiments, the dasher board assembly 20 includes only one foam strip 90 mounted to horizontal element 62, and does not include any other foam elements; in other words, there is no foam mounted with the vertical end frame elements 40, 44, top frame element 56, or bottom frame element 58. It is contemplated that the foam strip 90 may be mounted in various alternative arrangements while generally being positioned between the dasher board 30 and the internal frame assembly 38. In some embodiments, the foam strip 90 may be multiple foam strip segments spaced apart and arranged in series end-to-end. In other embodiments, the foam strip 90 may be mounted to other components of the internal frame assembly 38 such as the vertical mid frame element 60. Additional foam strips may be provided at additional locations about the dasher board 30 and/or internal frame assembly 38.

In certain embodiments, the foam strip 90 of the present disclosure may provide a variety of benefits. The foam strip 90 may dampen the motion of the dasher board 30 to reduce vibrations that may cause secondary impacts with a user. This dampening by the foam strip 90 also reduces fatigue in the dasher board 30 and thereby extends the useful life of the dasher board assembly 20 and/or dasher board 30. In certain embodiments, the foam strip 90 reduces or eliminates stresses at bolt locations of the dasher board 30 and/or the internal frame assembly 38. At the same time, the foam strip 90 may be an optional feature for the dasher board assembly 20, if in certain embodiments injury reduction is accomplished by the flexing of the dasher board 30 without interaction with, or dampening by, the foam strip 90.

In embodiments, the foam strip 90 may comprise a high resilience foam, for example high resilience polyurethane foam. In other embodiments, the foam strip 90 may be a viscoelastic polyurethane foam. In certain embodiments, the foam strip 90 comprises a foam material comprising specific details of foam, formulations, manufacturing processes, alternatives, etc. as disclosed in U.S. Pat. Nos. 5,171,759 and 6,855,742, the disclosures of which are incorporated herein in their entirety and for all purposes.

In some embodiments, the foam strip 90 comprises a foam categorized under ASTM D 3453-01 as high support (HS) or high support-high resilience (HS-HR), such HS foams having a minimum support factor of 2.3 whereas HS-HR foams have a minimum support factor of 2.4 and a minimum resilience of 55%. Support factor is the ratio of 65% IFD to 25% IFD and resilience is the Ball Rebound percentage. Measurement specifications for 25% IFD, 65% IFD and Ball Rebound are set forth in ASTM D 3574-01. In certain embodiments, the foam strip 90 is formed from a high support (HS) or high support-high resilience (HS-HR) flexible polyurethane foam prepared by the catalyzed reaction of one or more di- or polyisocyanates at an isocyanate index from about 70 to about 130 with: (a) a polyoxyalkylene polyol or polyoxyalkylene polyol blend having an average hydroxyl equivalent weight of at least about 1000 and an average primary hydroxyl content of at least about 25%; and (b) an effective amount of a blowing agent comprising water, in the presence of from about 0.01 to about 0.5 parts by weight based on 100 parts by weight of said polyol component (a) of a liquid hydrocarbon comprising greater than 50% of polymerized butadiene.

In certain embodiments, the dasher board assembly 20 comprises a kickboard 100 at the bottom end 66 of the assembly. In embodiments as shown in FIG. 3, the kickboard 100 comprises a front face 102 that may be flush with the dasher board 30 in an "inlaid" arrangement. In other embodiments, the kickboard may be arranged as an "overlay" arrangement in front of, or mounted on top of, a dasher board 30, with the dasher board 30 extending downward substantially to the ground and to the bottom of the kickboard 100. In embodiments particularly applicable to hockey, the kickboard 100 may be formed of a different material than the dasher board 30, for example HDPE, corresponding to the more rigid material of conventional dasher boards, which allows for a consistent feel of puck play and rebound that would be expected by hockey players.

In various embodiments of the disclosure, the dasher board assembly comprises a hinge assembly 110. The hinge assembly 110 comprises a spring 112 mounted with a bolt 114 and a hinge 116. The base member 68 may also be considered part of the hinge assembly 110 in that it mounts the bolt 114 and pivots about the hinge 116. The hinge assembly 110 allows the entirety of the dasher board assembly 20 and the internal frame assembly 38 to pivot relative to a ground surface about a horizontal axis defined by the hinge 116. In particular, the hinge assembly 110 allows dasher board assembly 20 rotate away from the rink or field of play, i.e., in the same direction as a user who collides with the dasher board assembly 20. In the illustrated embodiment, the spring 112 is a compression spring mounted coaxially about the bolt 114 and configured to compress when the dasher board assembly 20 rotates about the hinge 116. The spring 112 provides a return force for the dasher board assembly 20 to return to its upright vertical position. Additional features of the hinge assembly 110 may be included with the dasher board assembly 20 as disclosed in U.S. Pat. No. 6,004,217, the disclosure of which is incorporated herein in its entirety and for all purposes.

In some embodiments, the transparent panel 28 of the dasher board assembly 20 may also incorporate various impact reduction features as shown in FIGS. 1, 3 and 4. The transparent panel 28 is mounted to the top frame element 56 by a cap assembly 130. The cap assembly 130 may be a soft material that incorporates absorption ribs and channels to absorb impact forces, as disclosed in U.S. Patent Application Publication No. 2007/0287548, the disclosure of which is incorporated herein in its entirety and for all purposes. The dasher board assembly 20 and the transparent panel 28 may further include a shield 140 to provide a seamless assembly of multiple transparent panels 28, as disclosed in U.S. Patent Application Publication No. 2010/0288987, the disclosure of which is incorporated herein in its entirety and for all purposes.

Functionally, the dasher board assembly 20 disclosed herein is arranged to reduce the likelihood and severity of injuries when a user impacts the assembly. Head injuries in particular are known to be a product of the type of rapid deceleration experienced, for example, by a hockey player colliding with a dasher board. Generally, the dasher board 30 of the present disclosure has greater flexibility compared to conventional products. The arrangement of the internal frame 38 allows for a greater range of motion in the dasher board 30. The foam strip 90 may serve not only to cushion impacts when the dasher board 30 presses against it, but also dampen vibrations of the dasher board 30 to prevent secondary impacts between the dasher board and a user and more generally reduces fatigue and stress on the dasher board assembly 20. The hinge assembly 110 further mitigates injury by allowing the entire dasher board assembly 20 to move upon impact, including the relatively rigid internal frame assembly 38. Together, these components serve to spread out the time and space of deceleration of an impact relative to more rigid board assemblies. In other words, the impact occurs over a longer amount of time and the dasher board 30 moves a greater distance. An embodiment of the dasher board assembly 20 with a ⅜" polycarbonate dasher board 30 and 3" square foam strip 90 was tested using a standard Head Injury Criterion (d) test (HIC(d)) and compared to a conventional dasher board assembly of the same dimensions. The tested embodiment of the dasher board assembly did not include all features disclosed herein, and certain structures (including mounting structure) were the same for both the tested embodiment and the conventional assembly. It has been found that the greater flexibility of the dasher board 30 provides a reduction of about 55% in HIC(d) value compared to a conventional dasher board.

When combined with the hinge assembly 110 and/or other disclosed features, the dasher board assembly 20 generally provides a HIC reduction of 20-80%, and in certain embodiments a HIC reduction of about 40-80%, about 45-75%, and about 50-70%. Moreover, multiple locations on the dasher board 30 were tested, and it was found that the center of the dasher board 30 provides the best impact reduction, whereas conventional boards are stiffest at the center such that the center is considered by hockey players to be the worst place to impact a dasher board.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed. In embodiments, features disclosed for the entire dasher board assembly 20 may be implemented at only a portion thereof, implemented also at the kickboard, or implemented everywhere except at the top rail near the transparent panel 28. The present disclosure is also applicable to other sports or uses where impact reduction is desirable.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

We claim:

1. A dasher board assembly, comprising:

a pair of vertical end frame elements positioned at first and second lateral ends of the assembly, the pair of vertical end frame elements comprising a height and a depth;

a top frame element extending between the pair of vertical end frame elements at a top end of the dasher board assembly;

a bottom frame element extending between the pair of vertical end frame elements at a bottom end of the dasher board assembly;

a vertical mid frame element positioned between the pair of vertical end frame elements, the vertical mid frame element extending from the top end to the bottom end of the dasher board assembly, the vertical mid frame element having a depth;

a horizontal element intersecting the vertical mid frame element between the top end and the bottom end, the horizontal element having a depth, the vertical mid frame element and the horizontal element defining a combined depth that is less than the depth of the pair of vertical end frame elements;

a foam strip comprising high resilience polyurethane mounted in front of the horizontal element, the foam strip comprising a depth;

a dasher board positioned in front of the foam strip, the dasher board comprising polycarbonate and a depth of about ⅜ inch, the dasher board further comprising a dasher board front face;

a spline extending laterally from the dasher board and configured to attach the dasher board to an adjacent dasher board of an adjacent dasher board assembly, wherein the dasher board is only rigidly connected to the top frame element and the bottom frame element and only connects to the spline in between the top and bottom ends of the dasher board assembly;

a kickboard rigidly mounted to the bottom frame element and comprising a kickboard front face, the kickboard front face flush with the dasher board front face; and a hinge assembly configured to mount the assembly to a ground surface and configured to permit pivoting of the dasher board assembly about a horizontal axis, wherein the dasher board assembly comprises an envelope height comprising the height of the pair of vertical end frame elements, and wherein the dasher board assembly further comprises an envelope depth comprising the combined depth of the vertical mid frame element and the horizontal element further combined with the depth of the foam strip and the depth of the dasher board, wherein the envelope depth is up to about 6 inches.

2. The dasher board assembly of claim 1, wherein the foam strip in front of the horizontal element is the only foam material in the dasher board assembly.

3. The dasher board assembly of claim 1, the foam strip comprising a thickness of from about 3 to about 4 inches.

4. The dasher board assembly of claim 1, the foam strip configured to dampen vibrations of the dasher board after an impact.

5. The dasher board assembly of claim 1, the horizontal element being mounted recessed within the vertical mid frame element providing a flush face at the intersection of the horizontal element and the vertical mid frame element.

6. The dasher board assembly of claim 5, the flush face being spaced from the dasher board to define a gap of from about 2.5 inches to about 3.5 inches, wherein the dasher board assembly is configured to permit flexure of the dasher board into the gap to reduce negative acceleration of impacts with the dasher board assembly.

7. The dasher board assembly of claim 6, the gap being defined in all areas of the dasher board except along the bottom frame element and the top frame element.

8. The dasher board assembly of claim 1, the horizontal element comprising a cross-section defining an open side oriented toward the dasher board, the open side configured to receive the foam strip.

9. The dasher board assembly of claim 1, the pair of vertical end frame elements defining a depth of 5 inches.

10. The dasher board assembly of claim 1, the spline being positioned at the second lateral end of the dasher board assembly and comprising the same material as the dasher board.

11. The dasher board assembly of claim 1, the dasher board assembly further comprising a receiver at the first lateral end, the receiver configured to receive a spline from an adjacent dasher board to form a joint.

12. The dasher board assembly of claim 1, further comprising a bolt assembly configured to rigidly attach each of the pair of vertical end frame elements to an adjacent vertical end frame element of an adjacent dasher board assembly.

13. The dasher board assembly of claim 1, wherein the kickboard is mounted directly to the bottom frame element.

14. The dasher board assembly of claim 1, the hinge assembly comprising a spring biasing the dasher board assembly toward an upright position.

15. The dasher board assembly of claim 14, the hinge assembly comprising a hinge mounted below the bottom frame element and located at a front of the dasher board assembly proximate the kickboard, the spring mounted about a bolt located at a rear of the dasher board assembly.

16. The dasher board assembly of claim 1, further comprising a transparent panel supported by a cap assembly rigidly mounted to a top frame element, the cap assembly comprising at least one of ribs and channels and combinations thereof to absorb impacts.

17. The dasher board assembly of claim 1, further comprising a transparent panel extending upward and a shield mounted at each lateral end of the glass panel, the shield configured to provide a seamless assembly with adjacent glass panels.

18. A dasher board assembly defining an overall envelope height, envelope width, and envelope depth, the dasher board assembly comprising:

a dasher board comprising a thickness less than ½ inch, the dasher board comprising polycarbonate;

a pair of vertical end frame elements positioned at first and second lateral ends of the assembly, the pair of vertical end frame elements comprising a depth;

a vertical mid frame element positioned between the pair of vertical end frame elements and extending along substantially the entire envelope height of the dasher board assembly;

a horizontal element intersecting the vertical mid frame element, the vertical mid frame element and the horizontal element together defining a combined depth that is less than the depth of the vertical end frame elements; and a spline configured to attach the dasher board to an adjacent dasher board of an adjacent dasher board assembly, the spline comprising polycarbonate, wherein the dasher boards are not directly connected to the pair of vertical end frame elements, wherein the horizontal element is mounted recessed within the vertical mid frame element providing a flush face at the intersection of the horizontal element and the vertical mid frame element, the flush face spaced from the dasher board to define a gap of from about 2.5 inches to about 3.5 inches, and wherein the dasher board assembly is configured to permit flexure of the dasher board into the gap.

19. The dasher board assembly of claim 18, wherein the dasher board assembly does not comprise a foam material mounted between the horizontal element and the dasher board.

20. The dasher board assembly of claim 18, further comprising a hinge assembly configured to mount the assembly to a ground surface and configured to permit pivoting of the dasher board assembly about a horizontal axis.

* * * * *